US010800623B2

(12) United States Patent
Kamikawa

(10) Patent No.: US 10,800,623 B2
(45) Date of Patent: Oct. 13, 2020

(54) IMAGE FORMING APPARATUS

(71) Applicant: Brother Kogyo Kabushiki Kaisha, Nagoya (JP)

(72) Inventor: Kazuya Kamikawa, Nagakute (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/266,284

(22) Filed: Feb. 4, 2019

(65) Prior Publication Data

US 2019/0241382 A1 Aug. 8, 2019

(30) Foreign Application Priority Data

Feb. 5, 2018 (JP) ..... 2018-017759

(51) Int. Cl.

| | |
|---|---|
| ***B65H 85/00*** | (2006.01) |
| ***B65H 9/16*** | (2006.01) |
| ***B65H 29/52*** | (2006.01) |
| ***B65H 5/36*** | (2006.01) |
| ***B65H 5/06*** | (2006.01) |
| ***B65H 29/58*** | (2006.01) |

(Continued)

(52) U.S. Cl.

CPC ..... *B65H 5/36* (2013.01); *B65H 5/062* (2013.01); *B65H 9/166* (2013.01); *B65H 29/52* (2013.01); *B65H 29/58* (2013.01); *B65H 85/00* (2013.01); *G03G 15/234* (2013.01); *G03G 15/6529* (2013.01); *B65H 2403/43* (2013.01); *B65H 2404/143* (2013.01); *B65H 2404/611* (2013.01); *G03G 2215/00675* (2013.01)

(58) Field of Classification Search

CPC .... B65H 85/00; B65H 2402/60; B65H 9/166; B65H 5/38; B65H 2404/6111; G03G 15/6579; G03G 15/234

See application file for complete search history.

(56) References Cited

U.S. PATENT DOCUMENTS 8,632,069 B2 * 1/2014 Iino ..... B65H 85/00 271/225
8,695,974 B2 * 4/2014 Iino ..... B41J 3/60 271/248
9,527,689 B2 * 12/2016 Takami ..... B65H 5/062

(Continued)

FOREIGN PATENT DOCUMENTS

JP 2015-052709 A 3/2015

*Primary Examiner* — Luis A Gonzalez
(74) *Attorney, Agent, or Firm* — Burr & Brown, PLLC

(57) ABSTRACT

An image forming apparatus includes: an image forming unit; a first re-conveyance guide that guides a sheet on which an image is formed in a re-conveying direction; a second re-conveyance guide that guides the sheet from the first re-conveyance guide toward the image forming unit; a side guide provided at one end portion of the second re-conveyance guide in a widthwise direction to regulate the sheet; a side chute provided at one end portion of the first re-conveyance guide in the widthwise direction; and an engaging portion provided on the second re-conveyance guide. The engaging portion is engaged with a first engaging portion extending downward from an upstream end portion of the side guide in the re-conveying direction and is engaged with a second engaging portion provided on a downstream end portion of the side chute in the re-conveying direction.

17 Claims, 9 Drawing Sheets

(51) Int. Cl.
*G03G 15/00* (2006.01)
*G03G 15/23* (2006.01)

(56) References Cited

U.S. PATENT DOCUMENTS

| | | | | |
|---|---|---|---|---|
| 10,207,884 | B2 * | 2/2019 | Kamikawa | B65H 9/166 |
| 10,370,210 | B2 * | 8/2019 | Morita | B65H 31/02 |
| 10,474,090 | B2 * | 11/2019 | Ichiyanagi | G03G 21/1638 |
| 2013/0026705 | A1 * | 1/2013 | Masuda | G03G 15/234 271/225 |
| 2018/0314190 | A1 * | 11/2018 | Yin | B65H 9/16 |

* cited by examiner

IMAGE FORMING APPARATUS

CROSS REFERENCE TO RELATED APPLICATION

The present application claims priority from Japanese Patent Application No. 2018-017759, which was filed on Feb. 5, 2018, the disclosure of which is herein incorporated by reference in its entirety.

BACKGROUND OF THE INVENTION

1. Field of the Invention

The following disclosure relates to an image forming apparatus.

2. Description of Related Art

There is known a conventional image forming apparatus including a re-conveying mechanism. The re-conveying mechanism guides a sheet to an image forming unit again after an image is formed on a front surface of the sheet by the image forming unit. In the re-conveying mechanism, a position of the sheet in its widthwise direction is limited (determined) by a second guide and an end portion limiter provided on a first guide and located downstream of the second guide in the re-conveying direction.

In this image forming apparatus, the second guide and the first guide are positioned for accuracy of conveyance of the sheet for printing on its back surface.

SUMMARY OF THE INVENTION

In the image forming apparatus including the above-described re-conveying mechanism, the position of the sheet in the widthwise direction is limited by the second guide and the end portion limiter. Thus, low positional accuracy between the second guide and the end portion limiter unfortunately results in low accuracy of conveyance of the sheet for printing on its back surface.

In the conventional image forming apparatus, however, a configuration for positioning the second guide and the end portion limiter is not clear. Thus, the positioning accuracy between the second guide and the end portion limiter needs to be improved to improve the conveyance accuracy.

Accordingly, an aspect of the disclosure relates to an image forming apparatus with improved positioning accuracy between a side chute and a side guide.

In one aspect of the disclosure, an image forming apparatus includes: an image forming unit configured to form an image on a sheet; a first re-conveyance guide configured to guide a sheet on which an image is formed in a re-conveying direction; a second re-conveyance guide disposed downstream of the first re-conveyance guide in the re-conveying direction and configured to guide the sheet along a path extending from the first re-conveyance guide to the image forming unit; a side guide provided at one end portion of the second re-conveyance guide in a widthwise direction orthogonal to the re-conveying direction and configured to contact one end portion of the sheet to regulate of the sheet; a side chute provided at one end portion of the first re-conveyance guide in the widthwise direction and configured to guide the sheet in the re-conveyance direction toward the side guide; and an engaging portion provided on the second re-conveyance guide. The engaging portion is engaged with a first engaged portion extending downward from an upstream end portion of the side guide in the re-conveying direction and is engaged with a second engaged portion provided on a downstream end portion of the side chute in the re-conveying direction.

In another aspect of the disclosure, an image forming apparatus includes: an image forming unit configured to form an image on a sheet; a first re-conveyance guide configured to guide a sheet on which an image is formed in a re-conveying direction; a second re-conveyance guide disposed downstream of the first re-conveyance guide in the re-conveying direction and configured to guide the sheet along a path extending from the first re-conveyance guide to the image forming unit; a side guide provided at one end portion of the second re-conveyance guide in a widthwise direction orthogonal to the re-conveying direction and configured to contact one end portion of the sheet to regulate the sheet; a side chute provided at one end portion of the first re-conveyance guide in the widthwise direction and configured to guide the sheet in the re-conveyance direction toward the side guide; and a positioner formed integral with the second re-conveyance guide, the positioner being engaged with an upstream end portion of the side guide in the re-conveying direction to position the side guide with respect to the second re-conveyance guide, the positioner being engaged with a downstream end portion of the side chute in the re-conveying direction to position the side chute with respect to the second re-conveyance guide.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Hereinafter, there will be described one embodiment by reference to the drawings.

Figure 1:
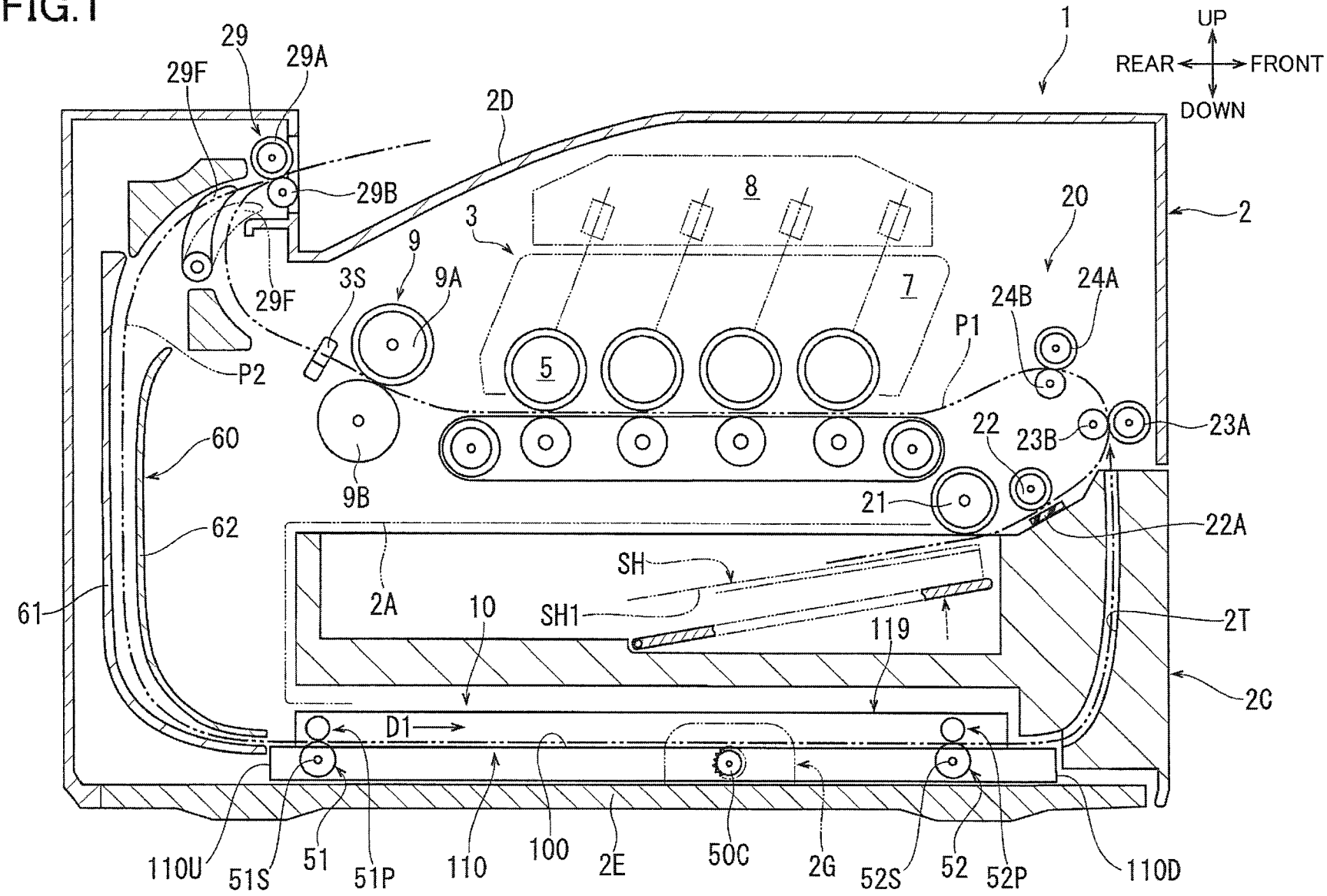
FIG. 1 is a schematic cross-sectional view of an image forming apparatus according to one embodiment.

As illustrated in FIG. 1, an image forming apparatus 1 according to the present embodiment is one example an image forming apparatus. The image forming apparatus 1 is an electronic photographic color laser printer configured to perform multiple-color printing to form an image on a sheet SH.

In FIG. 1, the right side of the sheet surface of FIG. 1 is defined as a front side of the image forming apparatus 1, and the left side when the image forming apparatus 1 is viewed from the front side, i.e., the front side of the sheet surface of FIG. 1, is defined as the left side. The front, rear, right, left, up, and down directions (sides) are defined with respect to these sides. The directions in the other figures correspond respectively to the directions in FIG. 1. There will be described elements of the image forming apparatus 1 with reference to the figures.

Overall Configuration

As illustrated in FIG. 1, the image forming apparatus 1 includes an apparatus body 2, a supplier 20, an image forming unit 3, an output unit 29, and a re-conveying mechanism 10.

The apparatus body 2 includes a housing and a frame, not illustrated, provided in the housing. A cassette accommodating section 2A is provided in the apparatus body 2. The cassette accommodating section 2A is open in a lower portion of a front surface of the apparatus body 2 and is recessed to the vicinity of a rear surface of the apparatus body 2.

A sheet cassette 2C is mounted in the cassette accommodating section 2A. The sheet cassette 2C is substantially shaped like a box opening upward. The sheet cassette 2C stores the sheets SH to be used for image printing in a stacked state. Examples of the sheet SH include a paper sheet and an OHP sheet. Though not illustrated, the sheet cassette 2C is drawn frontward from the cassette accommodating section 2A so as to be removed from the apparatus body 2.

An output tray 2D is provided on an upper surface of the apparatus body 2. The image-printed sheets SH are discharged onto the output tray 2D.

The supplier 20, the image forming unit 3, and the output unit 29 are provided above the cassette accommodating section 2A and the sheet cassette 2C in the apparatus body 2. The supplier 20, the image forming unit 3, and the output unit 29 are assembled to the frame, not illustrated. A controller and a drive source, not illustrated, are provided in the apparatus body 2. The supplier 20, the image forming unit 3, and the output unit 29 are controlled by the controller and operated by driving power transmitted from the drive source.

The re-conveying mechanism 10 includes a first re-conveyance guide 60, a second re-conveyance guide 110, and a third re-conveyance guide 2T.

The first re-conveyance guide 60 is provided in the apparatus body 2 so as to extend downward from the output unit 29 along a rear wall of the apparatus body 2. The first re-conveyance guide 60 is curved at a portion near a bottom wall 2E of the apparatus body 2 so as to extend frontward toward the second re-conveyance guide 110.

The second re-conveyance guide 110 is provided under the cassette accommodating section 2A and the sheet cassette 2C in the apparatus body 2. The second re-conveyance guide 110 extends in the front and rear direction along the bottom wall 2E of the apparatus body 2.

The third re-conveyance guide 2T is formed at a front portion of the sheet cassette 2C so as to extend from the second re-conveyance guide 110 toward the supplier 20.

Figure 2:
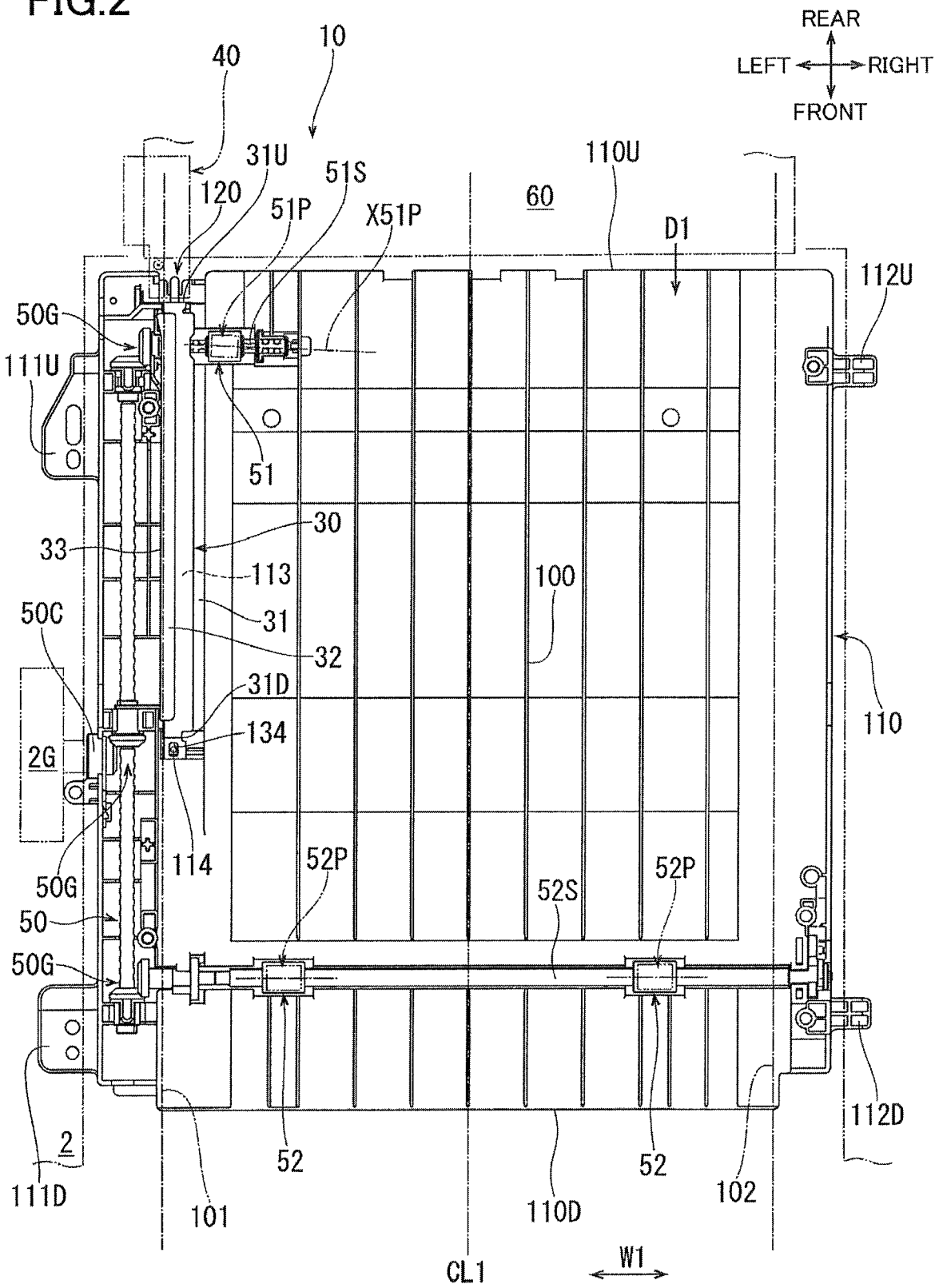
FIG. 2 is a partial top view for explaining a relative positional relationship among a first re-conveyance guide, a second re-conveyance guide, a side guide, and a side chute, for example.
Figure 3:
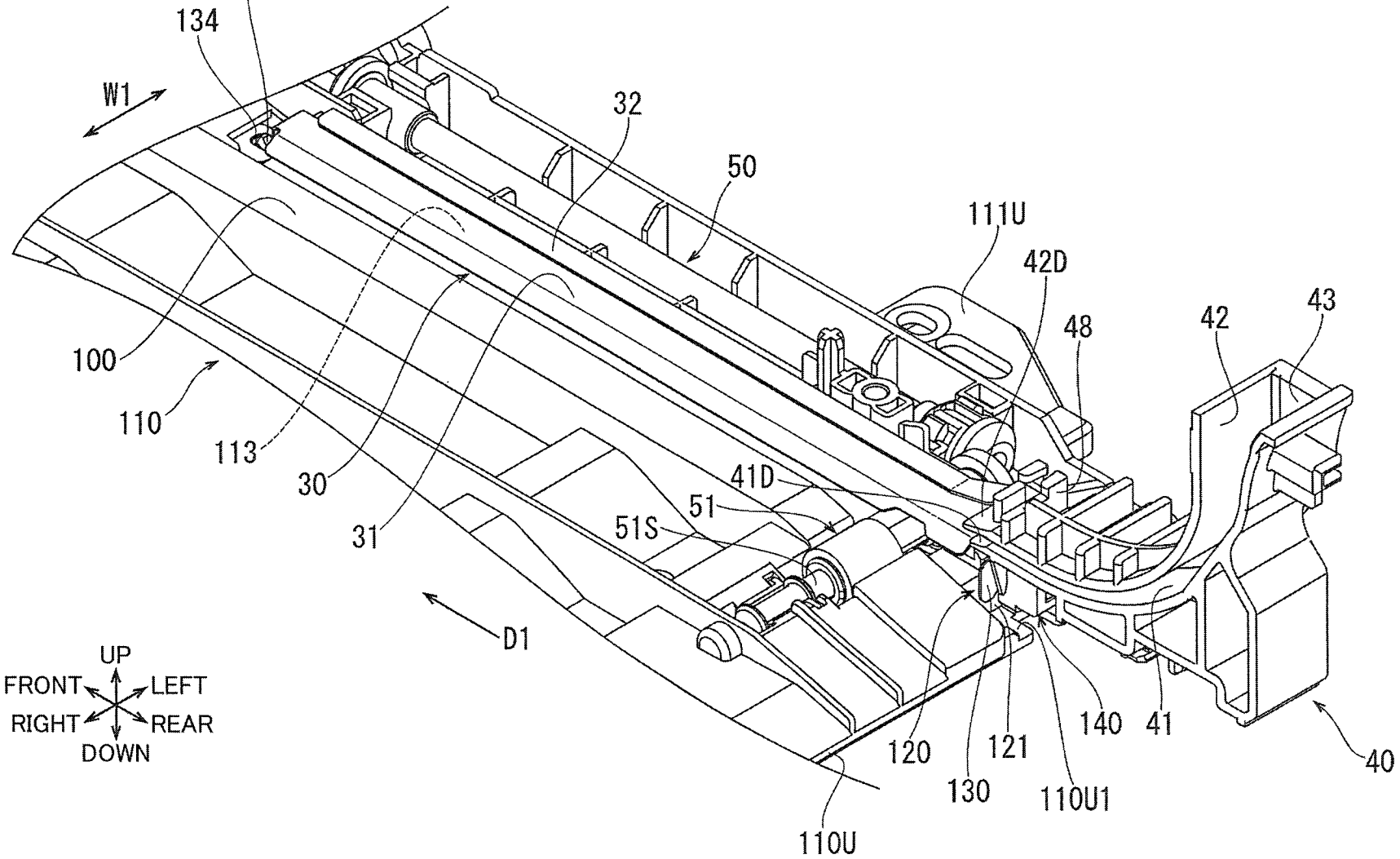
FIG. 3 is a partial perspective view of the side guide and the side chute positioned by the positioner of the second re-conveyance guide.

As illustrated in FIGS. 2 and 3, the re-conveying mechanism 10 includes a side guide 30 and a side chute 40. The side guide 30 is provided at a left end portion of the second re-conveyance guide 110. The side chute 40 is provided at a left end portion of the first re-conveyance guide 60.

The first re-conveyance guide 60, the second re-conveyance guide 110, the side guide 30, and the side chute 40 will be described later in detail.

As illustrated in FIG. 1, a conveyance path P1 and a re-conveyance path P2 are formed in the apparatus body 2.

The conveyance path P1 extends from a front end portion of the sheet cassette 2C to the output tray 2D so as to first make an upward U-turn via the supplier 20, then extend rearward substantially horizontally via the image forming unit 3, and finally make an upward U-turn via the output unit 29.

The re-conveyance path P2 extends from the output unit 29 to the supplier 20 so as to first extend downward from the output unit 29 along the first re-conveyance guide 60, then extend frontward substantially horizontally along the second re-conveyance guide 110, and extend upward along the third re-conveyance guide 2T.

The supplier 20 includes a supply roller 21, a separating roller 22, and a separator pad 22A which supply the sheets SH one by one from the sheet cassette 2C to the conveyance path P1. The supplier 20 further includes conveying rollers 23A, 24A and registering rollers 23B, 24B arranged at the U-turn portion of the conveyance path P1. These rollers 23A, 24A, 23B, 24B convey the sheet SH toward the image forming unit 3.

The image forming unit 3 is of what is called a direct tandem type and capable of performing color printing. The image forming unit 3 is a well-known image forming device including a process cartridge 7, a scanner 8, and a fixing unit 9.

The process cartridge 7 is a collection of four cartridges corresponding respectively to toners of black, yellow, magenta, and cyan and arranged in line along the substantially horizontal portion of the conveyance path P1. The process cartridge 7 includes four photoconductive drums 5 corresponding to the respective toners of the four colors, a developing roller, not illustrated, a charging unit, and toner containers.

The scanner 8 includes a laser light source, a polygon mirror, an fθ lens, and a reflective mirror. The scanner 8 emits a laser beam to the photoconductive drums 5 contained in the process cartridge 7 from above.

The fixing unit 9 is provided at a rear of the process cartridge 7. The fixing unit 9 includes: a heat roller 9A located on an upper side of the conveyance path P1; and a pressure roller 9B pressed against the heat roller 9A, with the conveyance path P1 interposed therebetween. The heat roller 9A and the pressure roller 9B of the fixing unit 9 heats and pressurizes the sheet SH having passed under the process cartridge 7.

A sensor 3S is provided at a rear of the heat roller 9A and the pressure roller 9B so as to face the conveyance path P1. The sensor 3S is a well-known sensor unit which includes: an actuator pivotable by its contact with the sheet SH; and an optical sensor, such as a photo interrupter, configured to detect movement of the actuator.

When the sheet SH passing through the fixing unit 9 is detected by the sensor 3S, a result of this detection is transmitted to the controller, not illustrated. Based on the result of the detection, the controller determines a progress of image forming performed by the image forming unit 3 and controls the timings of operations and stops of the above-described devices and components.

The image forming unit 3 forms an image on the sheet SH conveyed along the conveyance path P1 as follows. That is, a surface of each of the photoconductive drums 5 is positively charged uniformly by the charging unit with rotation of the photoconductive drum 5, and then exposed by the laser beam emitted from the scanner 8 and scanning the surface at a high speed. As a result, an electrostatic latent image corresponding to an image to be formed on the sheet SH is formed on the surface of the photoconductive drum 5. The toner is then supplied from each of the toner containers to the electrostatic latent image on the surface of a corresponding one of the photoconductive drums 5. A one-side surface SH1 of the sheet SH faces downward in a state in which the sheet SH is stored in the sheet cassette 2C. When the sheet SH is conveyed along the conveyance path P1 and passes through the image forming unit 3, the one-side surface SH1 of the sheet SH facing upward faces the photoconductive drums 5. The toner born on the surface of the photoconductive drum 5 is transferred to the one-side surface SH1 of the sheet SH and heated and pressurized by the fixing unit 9. These operations fix the toner to the sheet SH.

The output unit 29 includes an output roller 29A, an output pinch roller 29B, and a flapper 29F.

The output roller 29A and the output pinch roller 29B are located at the most downstream portion of the conveyance path P1 so as to face the output tray 2D. The output roller 29A is controlled by the controller, not illustrated, so as to be rotated forwardly and reversely. The output pinch roller 29B is pressed against the output roller 29A. The output pinch roller 29B is rotated by the forward rotation and the reverse rotation of the output roller 29A.

In the case where image forming is performed only on the one-side surface SH1 of the sheet SH, the output roller 29A is rotated forwardly in a state in which the sheet SH having passed through the fixing unit 9 is nipped between the output roller 29A and the output pinch roller 29B, whereby the output roller 29A and the output pinch roller 29B discharge the sheet SH onto the output tray 2D.

The flapper 29F is provided in the apparatus body 2 at a position located behind and below the output roller 29A and the output pinch roller 29B. The flapper 29F is pivotably supported at its lower end portion by the frame, not illustrated. The flapper 29F is pivotable between a position indicated by the solid line in FIG. 1 and a position indicated by the two-dot chain line in FIG. 1.

The flapper 29F is kept by a spring, not illustrated, to the position indicated by the two-dot chain line in FIG. 1. This spring has an urging force small enough to cause pivotal movement of the flapper 29F to the position indicated by the solid line in FIG. 1 when the sheet SH conveyed on the conveyance path P1 comes into contact with the flapper 29F.

In the case where the sheet SH is conveyed toward the output tray 2D along the conveyance path P1, the flapper 29F is pressed by the sheet SH and pivots to the position indicated by the solid line in FIG. 1 so as not to interfere with conveyance of the sheet SH. The flapper 29F guides the sheet SH such that the sheet SH reaches a position at which the sheet SH is nipped between the output roller 29A and the output pinch roller 29B.

When located at the position indicated by the two-dot chain line in FIG. 1, the flapper 29F extends along the re-conveyance path P2 in a state in which an upper end portion of the flapper 29F extends across the conveyance path P1. Thus, when the sheet SH is conveyed for printing on its back surface that is a back side of the sheet SH from the one-side surface SH1, the flapper 29F guides the sheet SH to the re-conveyance path P2.

The output roller 29A, the output pinch roller 29B, the sensor 3S, and the flapper 29F also serve as a mechanism for turning the sheet SH upside down. The sheet SH with the image formed on the one-side surface SH1 is turned upside down by the flapper 29F as follows.

That is, the controller, not illustrated, switches the rotation of the output roller 29A from the forward rotation to the reverse rotation at a particular timing, after the sensor 3S ceases detecting a trailing edge of the sheet SH, during conveyance of the sheet SH toward the output tray 2D by the output roller 29A and the output pinch roller 29B. The particular timing is set at the timing after the trailing edge of the sheet SH passes through the flapper 29F, and the flapper 29F pivots to the position indicated by the two-dot chain line in FIG. 1. As a result, the sheet SH is conveyed to the re-conveyance path P2 by the output roller 29A, the output pinch roller 29B, and the flapper 29F.

The sheet SH conveyed along the re-conveyance path P2 is conveyed to the conveyance path P1 by being guided by the first re-conveyance guide 60 and the side chute 40 of the re-conveying mechanism 10, then guided by the second re-conveyance guide 110 and the side guide 30, and finally guided by the third re-conveyance guide 2T. The sheet SH conveyed for printing on its back surface is conveyed again along the conveyance path P1 by the conveying rollers 23A, 24A and the registering rollers 23B, 24B of the supplier 20 and passes through the image forming unit 3 in a state in which the back surface of the sheet SH faces upward. As a result, an image is also formed on the back surface of the sheet SH. Thus, the sheet SH with the images formed on its opposite surfaces is discharged to the output tray 2D by the output roller 29A and the output pinch roller 29B.

In the present embodiment, the configurations of the first re-conveyance guide 60, the second re-conveyance guide 110, the side guide 30, and the side chute 40, which will be described below in detail, improve the accuracy of conveyance of the sheet SH for printing on its back surface.

Configuration of First Re-Conveyance Guide

The first re-conveyance guide 60 includes opposite walls 61, 62 arranged near a rear surface of the apparatus body 2. The opposite wall 61 extends downward from the output unit 29 along the rear wall of the apparatus body 2 and is curved at a position near the bottom wall 2E of the apparatus body 2 so as to extend frontward. The opposite wall 62 extends along the opposite wall 61. The opposite wall 62 is opposed from a front side to the portion of the opposite wall 61 which extends downward and is opposed from above to the portion of the opposite wall 61 which extends frontward.

A re-conveying direction in which the sheet SH is conveyed along the re-conveyance path P2 changes from the down direction to the front direction when the sheet SH passes through the first re-conveyance guide 60. The re-conveying direction is a substantially horizontally frontward direction when the sheet SH passes through the second re-conveyance guide 110. The following description will be provided with respect to a re-conveying direction D1 in which the sheet SH is conveyed frontward when passing through the second re-conveyance guide 110.

Configuration of Second Re-Conveyance Guide

As illustrated in FIGS. 1 and 2, the second re-conveyance guide 110 is disposed downstream of the first re-conveyance guide 60 in the re-conveying direction D1. The second re-conveyance guide 110 is a one-piece component formed by injection molding of thermoplastic resin, for example.

The second re-conveyance guide 110 is shaped like a substantially rectangular flat plate.

As illustrated in FIGS. 2-6, the second re-conveyance guide 110 has a conveying surface 100. The conveying surface 100 is formed by ribs and protruding and recessed upper edges of the second re-conveyance guide 110. That is, the conveying surface 100 is an imaginary plane on which the sheet SH is conveyed. The conveying surface 100 constitutes a portion of an upper surface of the second re-conveyance guide 110.

As illustrated in FIG. 2, the conveying surface 100 extends from an upstream end portion 110U to a downstream end portion 110D of the second re-conveyance guide 110 in the re-conveying direction D1. The widthwise direction W1 of the conveying surface 100 coincides with the right and left direction. One end of the conveying surface 100 in the widthwise direction W1 is a left end of the conveying surface 100. The other end of the conveying surface 100 in the widthwise direction W1 is a right end of the conveying surface 100.

The center line CL1 of the conveying surface 100 in the widthwise direction W1 is located at the center of the second re-conveyance guide 110 in the widthwise direction W1 and extends in the front and rear direction as the re-conveying direction D1. One edge 101 of the conveying surface 100 in the widthwise direction is located to the left of the center line CL1 and extends parallel with the center line CL1. The other edge 102 of the conveying surface 100 in the widthwise direction is located to the right of the center line CL1 and extends parallel with the center line CL1.

The conveying surface 100 is capable of guiding the sheet SH conveyed in the re-conveying direction D1 along the substantially horizontal portion of the re-conveyance path P2. The conveying surface 100 guides the sheet SH by contacting a lower surface of the sheet SH. The length of the conveying surface 100 in the widthwise direction W1, i.e., the distance between the one edge 101 and the other edge 102 in the widthwise direction, is set to a length corresponding to the width of the largest sheet SH conveyable for printing on its back surface. Examples of the width of the largest sheet SH conveyable for printing on its back surface include the widths of the legal size and the A4 sheet.

Like the length of the conveying surface 100, the length of the first re-conveyance guide 60 in the widthwise direction W1 is also set to the length corresponding to the width of the largest sheet SH conveyable for printing on its back surface.

As illustrated in FIG. 1, an upper-side guide plate 119 is mounted on the second re-conveyance guide 110 so as to be opposed to the conveying surface 100 from an upper side thereof. The upper-side guide plate 119 is capable of guiding the sheet SH conveyed in the re-conveying direction D1 along the substantially horizontal portion of the re-conveyance path P2. The upper-side guide plate 119 guides the sheet SH by contacting an upper surface of the sheet SH.

As illustrated in FIGS. 1 and 2, the second re-conveyance guide 110 is provided with a first roller 51 and two second rollers 52. The upper-side guide plate 119 is provided with a first pinch roller 51P and two second pinch rollers 52P.

The first roller 51 is disposed at the upstream end portion 110U of the second re-conveyance guide 110. The first roller 51 is secured to a rotation shaft 51S extending in the widthwise direction W1 such that the first roller 51 and the rotation shaft 51S are rotated together with each other.

The first pinch roller 51P is supported by the upper-side guide plate 119 so as to be opposed to the first roller 51 from an upper side thereof. The first pinch roller 51P is pressed against the first roller 51.

The second rollers 52 are disposed at the downstream end portion 110D of the second re-conveyance guide 110. As illustrated in FIG. 2, the second rollers 52 are secured to a rotation shaft 52S extending in the widthwise direction W1, in a state in which the second rollers 52 are spaced apart from each other.

The left second pinch roller 52P is supported by the upper-side guide plate 119 so as to be opposed to the left second roller 52 from an upper side thereof and pressed against the left second roller 52. The right second pinch roller 52P is supported by the upper-side guide plate 119 so as to be opposed to the right second roller 52 from an upper side thereof and pressed against the right second roller 52.

A rotation axis X51P of the first pinch roller 51P is inclined with respect to the widthwise direction W1 such that a right end of the first pinch roller 51P is located downstream of a left end of the first pinch roller 51P in the re-conveying direction D1.

As illustrated in FIGS. 1 and 2, a body-side transmitter 2G is provided in the apparatus body 2. The body-side transmitter 2G is assembled to the frame, not illustrated, at a position located to the left of a left surface of the second re-conveyance guide 110.

As illustrated in FIG. 2, a transmitter 50 is provided between the left surface of the second re-conveyance guide 110 and the one edge 101 of the conveying surface 100 in the widthwise direction. The transmitter 50 includes a coupled portion 50C and a transmission gear group 50G. The coupled portion 50C is coupled to the body-side transmitter 2G by a detachable coupling. The transmission gear group 50G includes a plurality of bevel gears and a transmission shaft. The transmission gear group 50G couples the coupled portion 50C and the rotation shaft 51S to each other and couples the coupled portion 50C and the rotation shaft 52S to each other.

When the supplier 20, the image forming unit 3, and the output unit 29 are operated by control of the controller, not illustrated, driving power transmitted from the drive source, not illustrated, is transmitted to the transmitter 50 via the body-side transmitter 2G and the coupled portion 50C. The transmission gear group 50G of the transmitter 50 transmits the driving power to the rotation shafts 51S, 52S. As a result, the first roller 51 and the second rollers 52 are rotated, whereby the first pinch roller 51P is rotated by the first roller 51, and the second pinch rollers 52P are rotated by the respective second rollers 52.

The sheet SH guided by the conveying surface 100 is nipped between the first roller 51 and the first pinch roller 51P and nipped between each of the second rollers 52 and a corresponding one of the second pinch rollers 52P and conveyed downstream in the re-conveying direction D1. In this operation, the inclination of the rotation axis X51P of the first pinch roller 51P causes the sheet SH guided by the conveying surface 100 to be conveyed obliquely toward the one edge 101 of the conveying surface 100 in the widthwise direction.

The second re-conveyance guide 110 has four engaging portions 111U, 111D, 112U, 112D. These engaging portions 111U, 111D, 112U, 112D are formed integrally with the second re-conveyance guide 110. The left engaging portions 111U, 111D protrude in the left direction from the left surface of the second re-conveyance guide 110 and are spaced apart from each other in the front and rear direction.

The right engaging portions 112U, 112D protrude in the right direction from a right surface of the second re-conveyance guide 110 and are spaced apart from each other in the front and rear direction.

The engaging portions 111U, 111D, 112U, 112D are engaged with the frame, not illustrated, whereby the second re-conveyance guide 110 is mounted on the apparatus body 2. Though not illustrated, the second re-conveyance guide 110 is removable from the apparatus body 2 by moving the engaging portions 111U, 111D, 112U, 112D away from the frame, not illustrated, and moving the coupled portion 50C of the transmitter 50 away from the body-side transmitter 2G in a state in which the bottom wall 2E of the apparatus body 2 is removed. The second re-conveyance guide 110 is mountable on the apparatus body 2 by operations in the reverse order.

Figure 6:
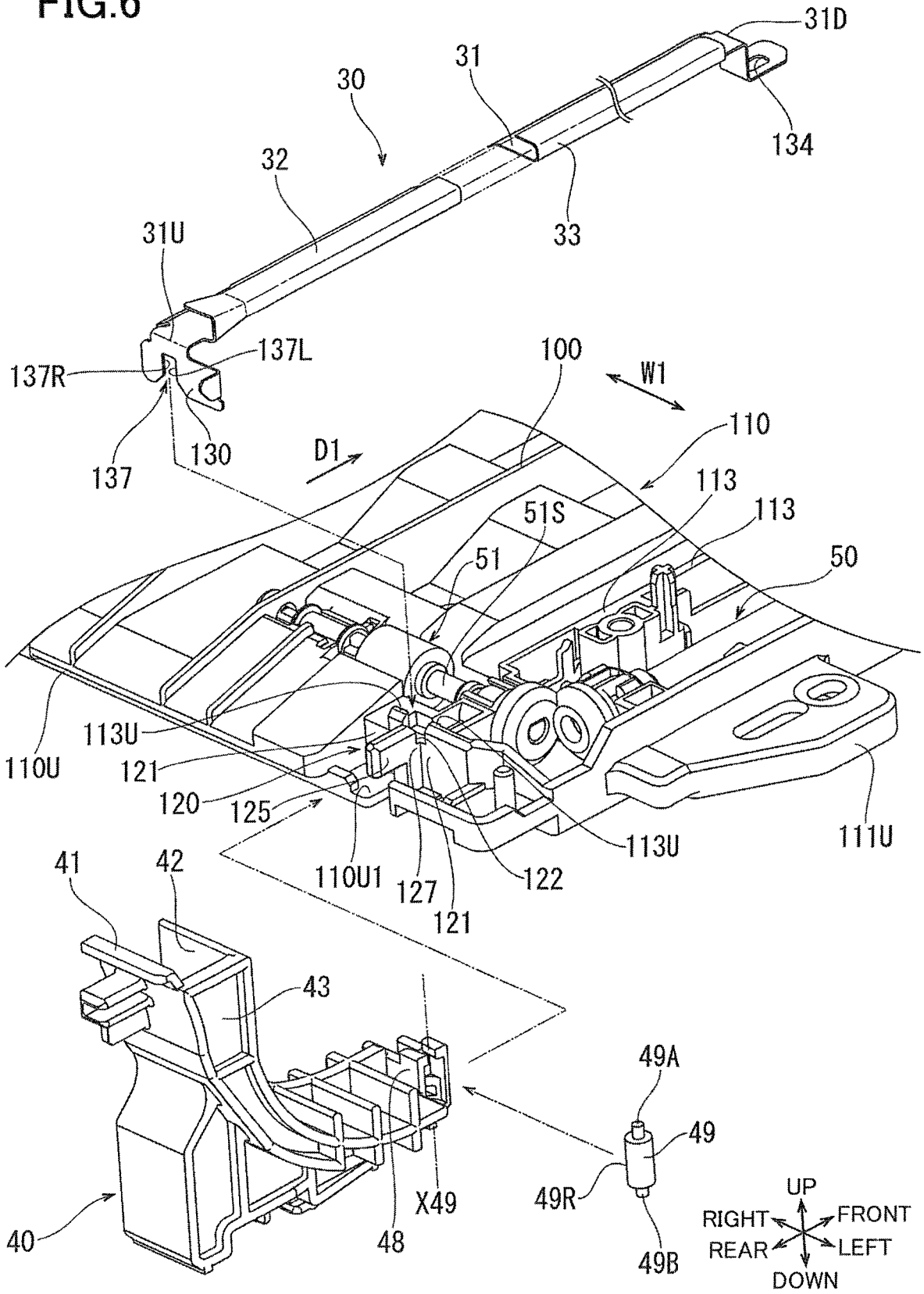
FIG. 6 is a partial perspective view of the second re-conveyance guide, the side guide, the side chute, and a pin spaced apart from each other.

As illustrated in FIG. 6, the second re-conveyance guide 110 has a side-guide support surface 113 for supporting the side guide 30 by contacting its lower surface. The side-guide support surface 113 is formed by ribs and protruding and recessed upper edges of the second re-conveyance guide 110. An upstream end portion 113U of the side-guide support surface 113 in the re-conveying direction D1 is located upstream of the rotation shaft 51S of the first roller 51 in the re-conveying direction D1.

Though FIG. 6 illustrates only a portion of the side-guide support surface 113 which is near the upstream end portion 113U, the side-guide support surface 113 is an elongated surface extending downstream in the re-conveying direction D1 along the one edge 101 of the conveying surface 100 illustrated in FIG. 2. The side-guide support surface 113 is located at an area overlapping the conveying surface 100 and is slightly lower in height than the conveying surface 100.

In FIGS. 2-5 and 7, the side-guide support surface 113 is in contact with the lower surface of the side guide 30 and covered with the side guide 30.

As illustrated in FIGS. 2 and 3, a positioning protrusion 114 is provided on the second re-conveyance guide 110. The positioning protrusion 114 positions a downstream end portion of the side guide 30 in the re-conveying direction D1. The positioning protrusion 114 is a circular cylindrical shaft protruding upward from the second re-conveyance guide 110 at a position located downstream of the side-guide support surface 113 in the re-conveying direction D1. The positioning protrusion 114 is located to the right of the one edge 101 of the conveying surface 100 illustrated in FIG. 2 in the widthwise direction.

Configuration of Positioner of Second Re-Conveyance Guide

As illustrated in FIGS. 2-8, a positioner 120 is formed at the upstream end portion 110U of the second re-conveyance guide 110. The positioner 120 positions an upstream end portion of the side guide 30 in the re-conveying direction D1 and a downstream end portion of the side chute 40 in the re-conveying direction D1.

Figure 7:
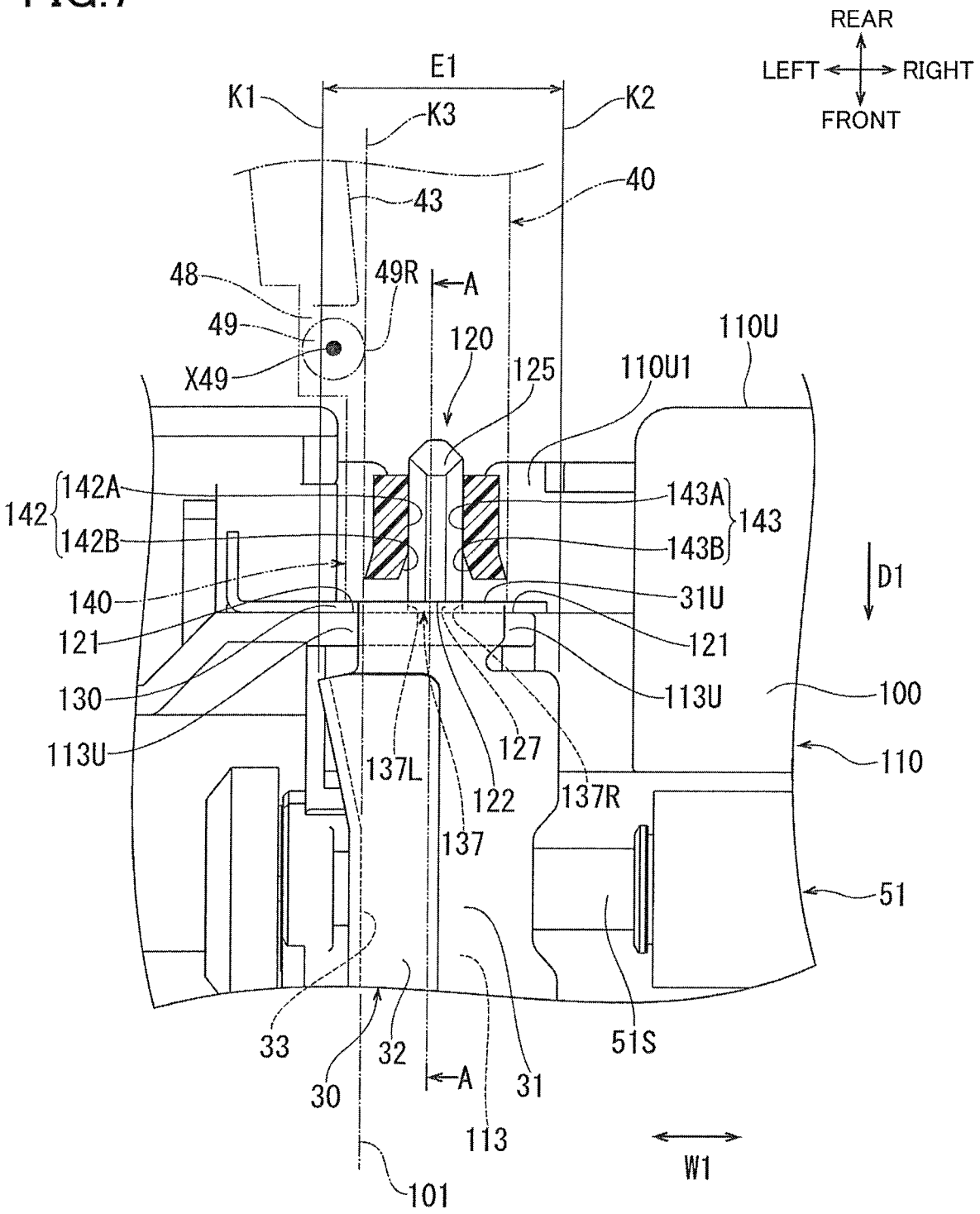
FIG. 7 is a partial top view for explaining a relative positional relationship among the positioner, the first positioned portion of the side guide, and the second positioned portion of the side chute, for example.
Figure 8:
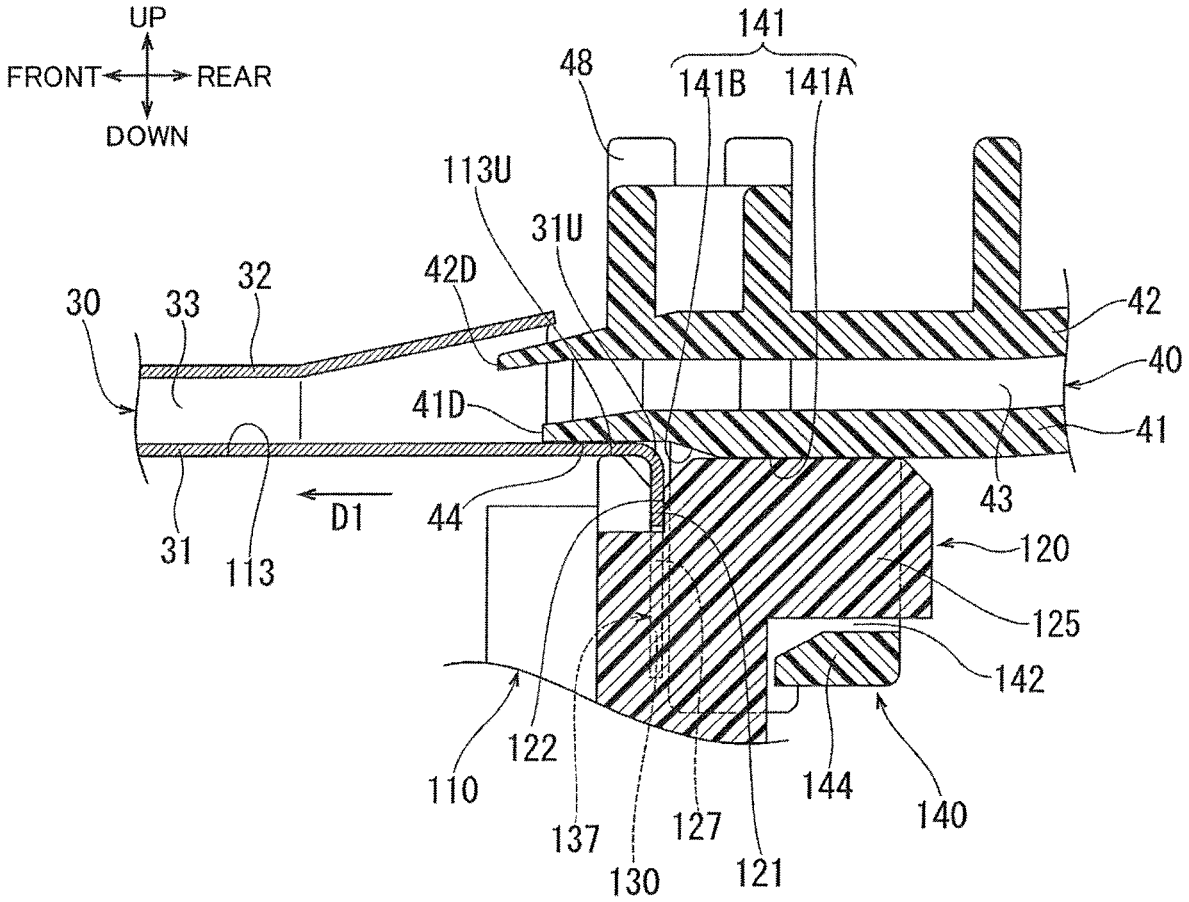
FIG. 8 is a partial cross-sectional view taken along line A-A in FIG. 7.

As illustrated in FIGS. 6-8, the positioner 120 includes a first contact portion 121, a second contact portion 122, a protruding portion 127, and a protrusion 125.

The first contact portion 121 is a flat surface having an upper edge connected to the upstream end portion 113U of the side-guide support surface 113. The first contact portion 121 extends in the down direction and the widthwise direction W1 and faces upstream in the re-conveying direction D.

The protruding portion 127 is located upstream of the first contact portion 121 in the re-conveying direction D1. The protruding portion 127 is a rib protruding upward from a bottom wall 110U1 of the upstream end portion 110U of the second re-conveyance guide 110 and connected to a substantially intermediate portion of the first contact portion 121 in the widthwise direction W1.

The protrusion 125 is connected to the protruding portion 127 at a position spaced apart from and located upstream of the first contact portion 121 in the re-conveying direction D1 and spaced apart from and above the bottom wall 110U1 of the upstream end portion 110U of the second re-conveyance guide 110. The protrusion 125 projects upstream in the re-conveying direction D1. The protrusion 125 has a substantially rectangular parallelepiped shape. A plurality of ridge lines and corner portions of the protrusion 125 are chamfered or rounded.

The second contact portion 122 is a flat surface of the protrusion 125 which faces downstream in the re-conveying direction D1. The second contact portion 122 is disposed above the protruding portion 127 at a particular distance from the first contact portion 121. The distance between the first contact portion 121 and the second contact portion 122 is substantially equal to the thickness of a first positioned portion 130 of the side guide 30, which will be described below, or slightly greater than the thickness of the first positioned portion 130.

Configuration of Side Guide

As illustrated in FIG. 6, the side guide 30 is formed by bending a metal plate in a substantially C shape in cross section and is elongated in the re-conveying direction D1. The side guide 30 includes a first guide wall 31, a second guide wall 32, and a third guide wall 33.

The first guide wall 31 extends in a substantially planar plate shape substantially parallel with the conveying surface 100. The third guide wall 33 is bent upward from a left edge of the first guide wall 31 so as to extend in the re-conveying direction D1 in a substantially planar plate shape. The second guide wall 32 is bent in the right direction from an upper edge of the third guide wall 33 and extends in the re-conveying direction D1 in a substantially planar plate shape while being opposed to the first guide wall 31.

The side guide 30 has the first positioned portion 130 (as one example of a first engaged portion) and a positioning elongated hole 134.

The first positioned portion 130 is a small piece having a substantially planar plate shape. The first positioned portion 130 extends downward from an upstream end portion 31U of the first guide wall 31 in the re-conveying direction D1 and extends in the widthwise direction W1. The first positioned portion 130 is formed integrally with the side guide 30. The first positioned portion 130 has a recessed portion 137. The recessed portion 137 is recessed upward from a lower edge of the first positioned portion 130. The recessed portion 137 has facing edges 137L, 137R. The facing edges 137L, 137R face each other in the widthwise direction W1 at a particular distance therebetween. The distance between the facing edge 137L and the facing edge 137R is substantially equal to the thickness of the protruding portion 127 of the positioner 120 in the widthwise direction W1 or slightly greater than the thickness of the protruding portion 127.

The positioning elongated hole 134 extends in the up and down direction through a small piece bent downward in a crank shape from a downstream end portion 31D of the first guide wall 31 in the re-conveying direction D1. The positioning elongated hole 134 has an oval shape extending in the re-conveying direction D1. The length of the positioning elongated hole 134 in the widthwise direction W1 is substantially equal to the outside diameter of the positioning protrusion 114 of the second re-conveyance guide 110 and slightly greater than the outside diameter of the positioning protrusion 114.

Figure 4:
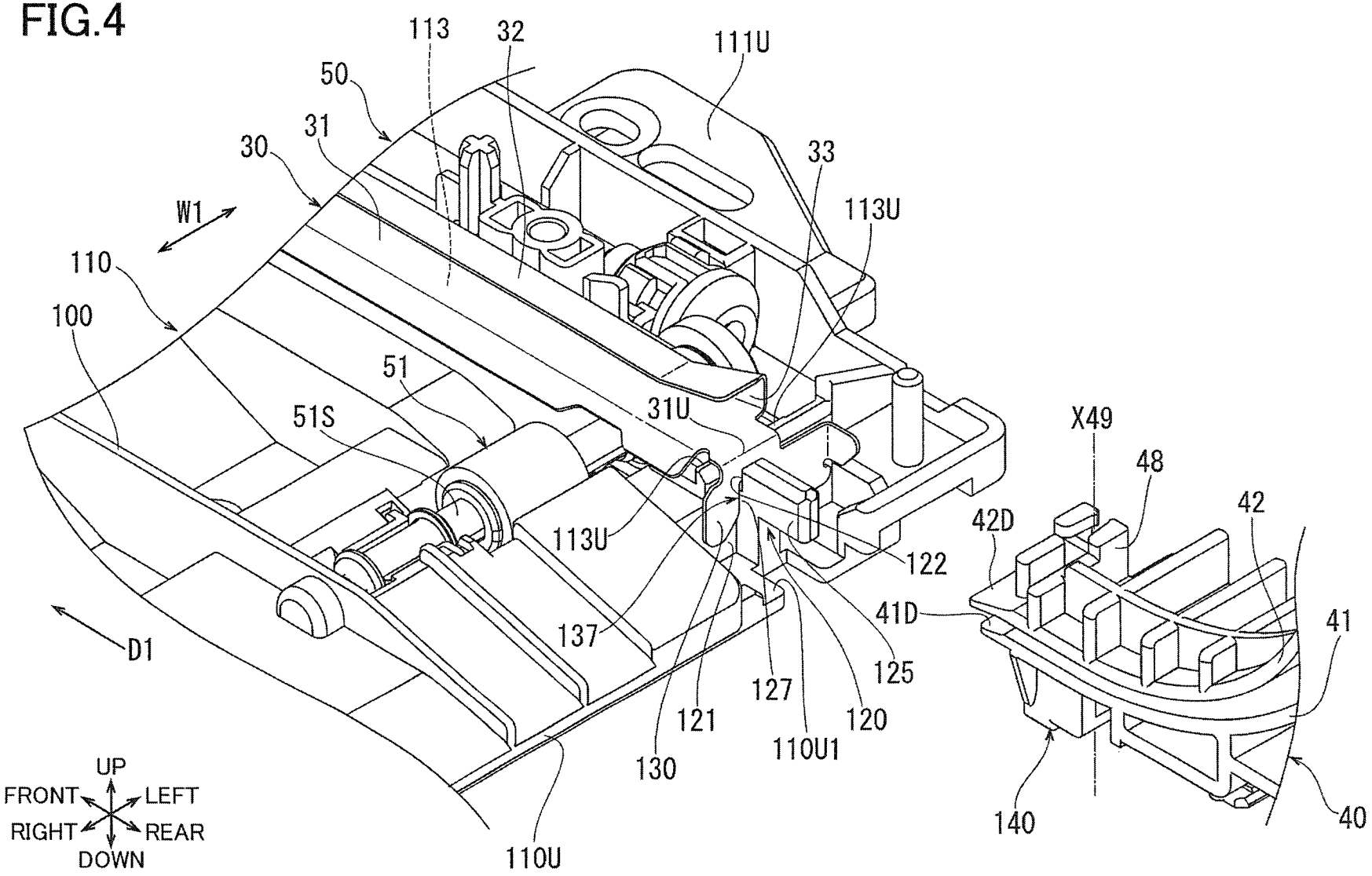
FIG. 4 is a partial perspective view illustrating the side guide positioned by the positioner of the second re-conveyance guide, and the side chute spaced apart from the positioner.

As illustrated in FIGS. 4, 7, and 8, since the first guide wall 31 is placed on the side-guide support surface 113, the upstream end portion 113U of the side-guide support surface 113 contacts a lower surface of the upstream end portion 31U of the first guide wall 31. With this configuration, the upstream end portion of the side guide 30 in the re-conveying direction D1 is accurately positioned in the up and down direction.

The first contact portion 121 of the positioner 120 contacts the first positioned portion 130 from a downstream side thereof in the re-conveying direction D1. The second contact portion 122 of the positioner 120 contacts the first positioned portion 130 from an upstream side thereof in the re-conveying direction D1. That is, the first positioned portion 130 is held by and interposed between the first contact portion 121 and the second contact portion 122 in the re-conveying direction D1. With this configuration, the upstream end portion of the side guide 30 in the re-conveying direction D1 is accurately positioned in the re-conveying direction D1.

The protruding portion 127 of the positioner 120 protrudes toward the recessed portion 137 of the first positioned portion 130. As illustrated in FIG. 7, the facing edge 137L of the recessed portion 137 contacts the protruding portion 127 located in the recessed portion 137, from a left side of the protruding portion 127. The facing edge 137R of the recessed portion 137 contacts the protruding portion 127 located in the recessed portion 137, from a right side of the protruding portion 127. That is, the protruding portion 127 is held by and interposed between the facing edges 137L, 137R of the recessed portion 137 in the widthwise direction W1. With this configuration, the upstream end portion of the side guide 30 in the re-conveying direction D1 is accurately positioned in the widthwise direction W1.

As illustrated in FIGS. 2 and 3, the positioning protrusion 114 of the second re-conveyance guide 110 is fitted in the positioning elongated hole 134 formed in the downstream end portion 31D of the first guide wall 31. With this configuration, the downstream end portion of the side guide 30 in the re-conveying direction D1 is accurately positioned in the widthwise direction W1.

Thus, the side guide 30 is mounted on a left end portion of the conveying surface 100 of the second re-conveyance guide 110. In this state, the first guide wall 31 guides the sheet SH guided by the conveying surface 100, by contacting the lower surface of the sheet SH. The second guide wall 32 guides the sheet SH guided by the conveying surface 100, by contacting the upper surface of the sheet SH. As illustrated in FIG. 2, the third guide wall 33 is located on the one edge 101 of the conveying surface 100 in the widthwise direction and extends in the re-conveying direction D1. The third guide wall 33 contacts the left edge of the sheet SH conveyed obliquely toward the one edge 101 of the conveying surface 100 in the widthwise direction and guided by the conveying surface 100, thereby accurately limiting the position of the sheet SH in the widthwise direction W1.

Configuration of Side Chute

Figure 5:
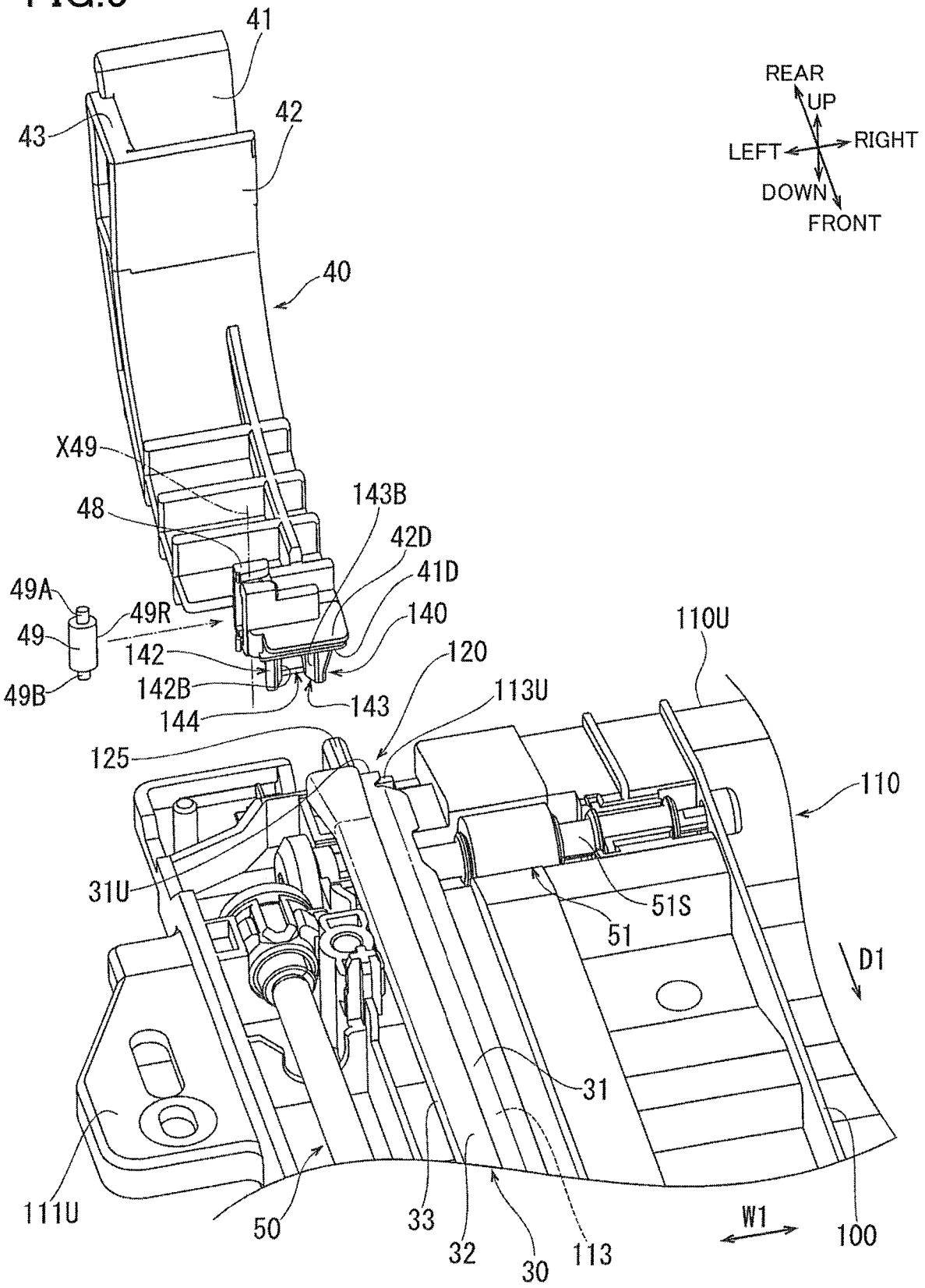
FIG. 5 is a partial perspective view illustrating the side guide positioned by the positioner of the second re-conveyance guide, and the side chute spaced apart from the positioner.
Figure 9:
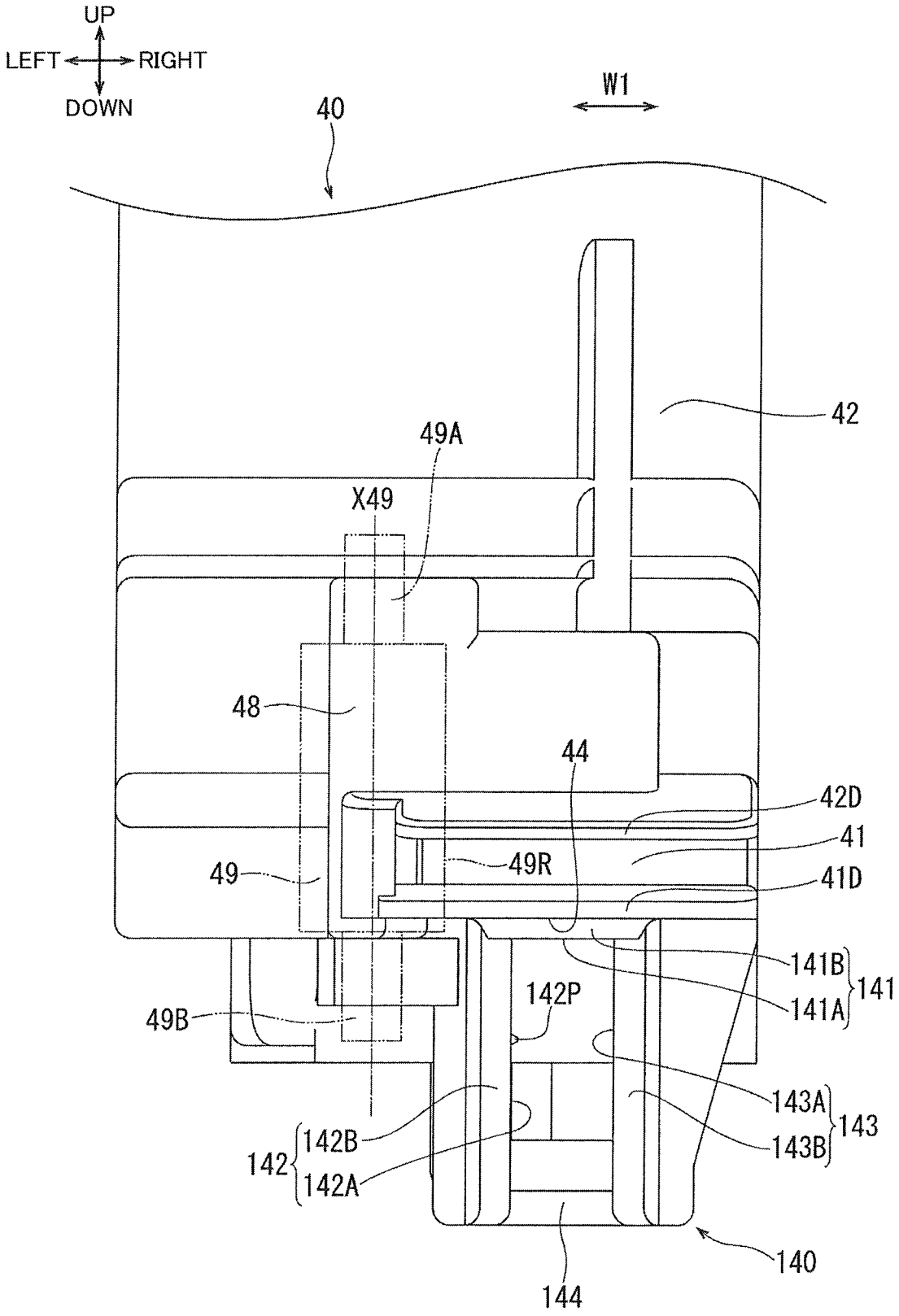
FIG. 9 is a partial front elevational view of the side chute.

As illustrated in FIGS. 2 and 3, the side chute 40 is provided at a left end portion of the curved portion of the first re-conveyance guide 60 and upstream of the side guide 30 in the re-conveying direction D1. As illustrated in FIGS. 5, 6, and 9, the side chute 40 is a one-piece component formed by injection molding of thermoplastic resin, for example.

The side chute 40 includes a first chute wall 41, a second chute wall 42, a third chute wall 43, and a supporter 48*z*. The side chute 40 includes a metal pin 49.

The first chute wall 41 is curved along the opposite wall 61 of the first re-conveyance guide 60 illustrated in FIG. 1. The second chute wall 42 is curved along the opposite wall 62 of the first re-conveyance guide 60 illustrated in FIG. 1 and opposed to the first chute wall 41. A downstream end portion 42D of the second chute wall 42 in the re-conveying direction D1 is opposed from above to a downstream end portion 41D of the first chute wall 41 in the re-conveying direction D1. The third chute wall 43 connects a left end portion of the first chute wall 41 and a left end portion of the second chute wall 42 to each other.

A plurality of reinforcing ribs are formed on the first chute wall 41, the second chute wall 42, and the third chute wall 43.

The supporter 48 is connected to the downstream end portion 41D of the first chute wall 41 and the downstream end portion 42D of the second chute wall 42 from a left side thereof.

The pin 49 has a circular cylindrical shape. An engaged shaft 49A protrudes upward from an upper end face of the pin 49. An engaged shaft 49B protrudes downward from a lower end face of the pin 49.

The supporter 48 is engaged with the engaged shafts 49A, 49B to support the pin 49 at a left end portion of the downstream end portion 41D of the first chute wall 41 and a left end portion of the downstream end portion 42D of the second chute wall 42. The pin 49 is supported by the supporter 48 such that the center of the pin 49 coincides with the axis X49 in a direction orthogonal to the conveying surface 100.

As illustrated in FIG. 9, a right end portion 49R of an outer circumferential surface of the pin 49 is exposed to a space located between the downstream end portion 41D of the first chute wall 41 and the downstream end portion 42D of the second chute wall 42. As illustrated in FIG. 7, the third chute wall 43 is inclined in the right direction so as to be nearer to the right end portion 49R of the outer circumferential surface of the pin 49 at a downstream portion of the third chute wall 43 than at an upstream portion of the third chute wall 43 in the re-conveying direction D1.

As illustrated in FIGS. 5 and 7-9, a second positioned portion 140 (as one example of a second engaged portion) is provided at the downstream end portion of the side chute 40 in the re-conveying direction D1. The second positioned portion 140 is formed integrally with the side chute 40. The second positioned portion 140 is connected to a lower surface of the first chute wall 41 at the downstream end portion 41D.

The second positioned portion 140 includes a first restricting portion 141, a second restricting portion 142, a third restricting portion 143, and a connector 144.

As illustrated in FIGS. 8 and 9, the first restricting portion 141 is formed at a portion of the lower surface of the first chute wall 41. The first restricting portion 141 includes a limiting surface 141A and an inclined surface 141B. As illustrated in FIG. 8, the limiting surface 141A is a flat surface extending in the re-conveying direction D1 and the widthwise direction W1 and facing downward. The inclined surface 141B is connected to and located downstream of the limiting surface 141A in the re-conveying direction D1. The inclined surface 141B is inclined so as to be higher at its downstream portion than at its upstream portion in the re-conveying direction D1.

As illustrated in FIG. 9, a left end portion of the first restricting portion 141 is connected to a lower end portion of the supporter 48. In other words, the supporter 48 is formed so as to extend upward from the first restricting portion 141.

As illustrated in FIGS. 5 and 7-9, the second restricting portion 142 is connected to a left end of the first chute wall 41 and extends downward from the first chute wall 41. The second restricting portion 142 includes a limiting surface 142A and an inclined surface 142B. As illustrated in FIG. 7, the limiting surface 142A is a flat surface extending in the re-conveying direction D1 and the up and down direction and facing rightward. The inclined surface 142B is connected to and located downstream of the limiting surface 142A in the re-conveying direction D1. The inclined surface 142B is inclined such that its downstream portion is located on a left side of its upstream portion in the re-conveying direction D1.

As illustrated in FIGS. 5 and 7-9, the third restricting portion 143 is connected to a right end of the first chute wall 41 and extends downward from the first chute wall 41. That is, the third restricting portion 143 is disposed at a position opposed to the second restricting portion 142. The third restricting portion 143 includes a limiting surface 143A and an inclined surface 143B. As illustrated in FIG. 7, the limiting surface 143A is a flat surface extending in the re-conveying direction D1 and the up and down direction and facing leftward. The inclined surface 143B is connected to and located downstream of the limiting surface 143A in the re-conveying direction D1. The inclined surface 143B is inclined such that its downstream portion is located on a right side of its upstream portion in the re-conveying direction D1.

As illustrated in FIGS. 5, 8, and 9, the connector 144 connects a lower end portion of the second restricting portion 142 and a lower end portion of the third restricting portion 143 to each other at a position located below the first restricting portion 141 and spaced apart from the first restricting portion 141.

The limiting surface 141A of the second restricting portion 142 and the limiting surface 143A of the third restricting portion 143 face each other in the widthwise direction W1 at a particular distance. The distance between the limiting surface 141A and the limiting surface 143A is substantially equal to the thickness of the protrusion 125 of the positioner 120 in the widthwise direction W1 or slightly greater than the thickness of the protrusion 125. The connector 144 reinforces the second restricting portion 142 and the third restricting portion 143 to prevent changes in the distance between the limiting surface 141A and the limiting surface 143A.

As illustrated in FIG. 9, a protruding member 142P is formed on the limiting surface 142A of the second restricting portion 142. The protruding member 142P is a rib protruding in the right direction with a short length from an intermediate portion of the limiting surface 142A in the up and down direction and extending in the re-conveying direction D1. That is, the protruding member 142P protrudes toward the third restricting portion 143.

As illustrated in FIG. 8, a fourth restricting portion 44 is provided on the first chute wall 41 of the side chute 40. The fourth restricting portion 44 is a portion of a lower surface of the first chute wall 41 and formed between the downstream end portion 41D of the first chute wall 41 and the inclined surface 141B of the first restricting portion 141. The fourth restricting portion 44 is a flat surface extending in the re-conveying direction D1 and the widthwise direction W1 and facing downward. The fourth restricting portion 44 extends to a position located downstream of the second restricting portion 142 and the third restricting portion 143 in the re-conveying direction D1.

As illustrated in FIGS. 7 and 8, the second positioned portion 140 of the side chute 40 is engaged with the positioner 120 as follows in the state in which the positioner 120 of the second re-conveyance guide 110 is engaged with the first positioned portion 130 of the side guide 30.

That is, the protrusion 125 of the positioner 120 is inserted into a space defined by the first restricting portion 141, the second restricting portion 142, and the third restricting portion 143 of the second positioned portion 140. In this operation, the protrusion 125 can be smoothly inserted to the bottom of the space by being guided by the inclined surface 141B of the first restricting portion 141, the inclined surface 142B of the second restricting portion 142, and the inclined surface 143B of the third restricting portion 143.

In the state in which the protrusion 125 is inserted in the space defined by the first restricting portion 141, the second restricting portion 142, and the third restricting portion 143, as illustrated in FIG. 8, the limiting surface 141A of the first restricting portion 141 contacts an upper surface of the protrusion 125. With this configuration, the downstream end portion of the side chute 40 in the re-conveying direction D1 is accurately positioned in the up and down direction.

As illustrated in FIG. 7, the limiting surface 142A of the second restricting portion 142 contacts the protrusion 125 from a left side thereof. The limiting surface 143A of the third restricting portion 143 contacts the protrusion 125 from a right side thereof. In the state in which the limiting surface 142A and the limiting surface 143A are in contact with the protrusion 125, though not illustrated, the protruding member 142P is located between the limiting surface 142A and a left surface of the protrusion 125 to eliminate a space therebetween. That is, the protrusion 125 is held by and between the limiting surface 142A of the second restricting portion 142 and the limiting surface 143A of the third restricting portion 143 in the widthwise direction W1. With this configuration, the downstream end portion of the side chute 40 in the re-conveying direction D1 is accurately positioned in the widthwise direction W1. It is noted that, as described above, the protruding portion 127 provided on the second re-conveyance guide 110 is inserted in the recessed portion 137 formed in the side guide 30, thereby accurately positioning the side guide 30 with respect to the second re-conveyance guide 110 in the widthwise direction W1. Likewise, the protrusion 125 provided on the second re-conveyance guide 110 is inserted in the space defined by the first restricting portion 141, the second restricting portion 142, and the third restricting portion 143 provided on the side chute 40, whereby the side chute 40 is accurately positioned with respect to the second re-conveyance guide 110 in the widthwise direction W1. Here, as illustrated in FIG. 6, it is possible to consider that the protruding portion 127 and the protrusion 125 are one positioning protrusion formed in one piece so as to protrude upward from the second re-conveyance guide 110. In the case where the protruding portion 127 and the protrusion 125 are considered in this manner, the one positioning protrusion is inserted in the recessed portion 137, and the positioning protrusion and the portion constituting the recessed portion 137 are in contact (engagement) with each other, whereby the side guide 30 is positioned with respect to the second re-conveyance guide 110. The one positioning protrusion is inserted in the space defined by the first to third restricting portions 141, 142, 143, and the positioning protrusion and at least one of the first to third restricting portions 141, 142, 143 are in engagement (contact) with each other, whereby the side chute 40 is positioned with respect to the second re-conveyance guide 110. Accordingly, it is possible to reduce positional misalignment of the side chute 40 with respect to the side guide 30. It is noted that the position of engagement between the side guide 30 and the positioning protrusion is located downstream of the position of engagement between the side chute 40 and the positioning protrusion in the re-conveying direction D1. This configuration enables the side guide 30 and the side chute 40 to be positioned with respect to the one positioning protrusion at the respective positions of the side guide 30 and the side chute 40 in the re-conveying direction. Thus, the positional misalignment of the side chute 40 with respect to the side guide 30 can be reduced by the one positioning protrusion.

When the second positioned portion 140 is engaged with the positioner 120, as illustrated in FIG. 8, the downstream end portion 41D of the first chute wall 41 is located above the first guide wall 31. The downstream end portion 42D of the second chute wall 42 is located below the second guide wall 32. In this state, the fourth restricting portion 44 is in contact with the first guide wall 31 from an upper side thereof. Thus, it is possible to accurately position the downstream end portion 41D of the first chute wall 41 and the downstream end portion 42D of the second chute wall 42 with respect to the side guide 30 in the up and down direction.

As illustrated in FIG. 7, the positioner 120 is disposed at a position overlapping the side guide 30 in the widthwise direction W1. Each of the first restricting portion 141, the second restricting portion 142, and the third restricting portion 143 is also disposed at a position overlapping a portion of the side guide 30 in the widthwise direction W1.

Specifically, FIG. 7 illustrates an extension line K1 extended upstream in the re-conveying direction D1 from a left end of the side guide 30. FIG. 7 also illustrates an extension line K2 extended upstream in the re-conveying direction D1 from a right end of the side guide 30. The positioner 120 is disposed at a position overlapping the region E1 located between the extension line K1 and the extension line K2. That is, at least a portion of an area occupied by the side guide 30 in the widthwise direction W1 is an area (the region E1) located between the extension line K1 and the extension line K2, and this area overlays at least a portion of an area occupied by the positioner 120 in the widthwise direction W1. Each of the first restricting portion 141, the second restricting portion 142, and the third restricting portion 143 is also disposed at a position overlapping a portion of the region E1. That is, a portion of the area (the region E1) located between the extension line K1 and the extension line K2, which area is the area occupied by the side guide 30 in the widthwise direction W1, overlays the area occupied by each of the first restricting portion 141, the second restricting portion 142, and the third restricting portion 143 in the widthwise direction W1.

As illustrated in FIG. 8, in the state in which the upstream end portion of the side guide 30 in the re-conveying direction D1 and the downstream end portion of the side chute 40 in the re-conveying direction D1 are positioned with respect to each other by the positioner 120, the downstream end portion 41D of the first chute wall 41 guides the sheet SH guided by the first re-conveyance guide 60, by contacting the lower surface of the sheet SH. The downstream end portion 42D of the second chute wall 42 guides the sheet SH guided by the first re-conveyance guide 60, by contacting the upper surface of the sheet SH.

As illustrated in FIG. 7, the right end portion 49R of the outer circumferential surface of the pin 49 is in contact with an extension line K3 formed by extending, upstream in the re-conveying direction D1, the one edge 101 of the conveying surface 100 in the widthwise direction. The right end portion 49R of the outer circumferential surface of the pin 49 contacts the left edge of the sheet SH guided by the first re-conveyance guide 60, thereby limiting (determining) the position of the sheet SH in the widthwise direction W1. In this state, the third chute wall 43 guides the sheet SH such that the left edge of the sheet SH guided by the first re-conveyance guide 60 does not contact the pin 49.

This configuration enables the side chute 40 to accurately guide the sheet SH guided by the first re-conveyance guide 60, to the side guide 30.

Effects

In the image forming apparatus 1 according to the present embodiment, as illustrated in, e.g., FIGS. 7 and 8, the downstream end portion of the side chute 40 in the re-conveying direction D1 and the upstream end portion of the side guide 30 in the re-conveying direction D1 are positioned with respect to each other by the positioner 120 as one component. This configuration reduces the positional misalignment of the side chute 40 with respect to the side guide 30.

In particular, the third guide wall 33 of the side guide 30 is accurately positioned on the one edge 101 of the conveying surface 100 in the widthwise direction. The right end portion 49R of the outer circumferential surface of the pin 49 supported by the supporter 48 of the side chute 40 is accurately positioned such that the one edge 101 of the conveying surface 100 in the widthwise direction contacts the extension line K3 extended upstream in the re-conveying direction D1. These positionings reduce the positional misalignment between the third guide wall 33 of the side guide 30 and the right end portion 49R of the outer circumferential surface of the pin 49.

As a result, the side chute 40 accurately guides the sheet SH guided by the first re-conveyance guide 60, to the side guide 30. The side guide 30 accurately limits the position of the sheet SH guided by the conveying surface 100, in the widthwise direction W1.

Accordingly, the image forming apparatus 1 according to the present embodiment improves the accuracy of positioning between the side chute 40 and the side guide 30 and improves the accuracy of conveyance of the sheet SH for printing on its back surface.

In this image forming apparatus 1, as illustrated in FIG. 7, the positioner 120 is disposed at the position overlapping the side guide 30 in the widthwise direction W1. Specifically, the positioner 120 is disposed at the position overlapping the region E1 located between the extension line K1 and the extension line K2. This configuration reduces a distance between the second positioned portion 140 of the side chute 40 and the first positioned portion 130 of the side guide 30, resulting in further reduction in the positional misalignment of the side chute 40 with respect to the side guide 30. This further improves the accuracy of conveyance of the sheet SH for printing on its back surface.

In this image forming apparatus 1, as illustrated in FIGS. 6 and 8, the first positioned portion 130 of the side guide 30 is held by and between the first contact portion 121 and the second contact portion 122 of the positioner 120 in the re-conveying direction DE thereby accurately positioning the side guide 30 in the re-conveying direction D1.

In this image forming apparatus 1, as illustrated in FIGS. 6 and 7, the protruding portion 127 of the positioner 120 is held by and between the facing edges 137L, 137R of the recessed portion 137 of the first positioned portion 130 in the widthwise direction W1, thereby accurately positioning the side guide 30 in the widthwise direction W1.

In this image forming apparatus 1, as illustrated in FIG. 7, each of the first restricting portion 141, the second restricting portion 142, and the third restricting portion 143 is disposed at the position overlaying a portion of the side guide 30 in the widthwise direction W1. Specifically, each of the first restricting portion 141, the second restricting portion 142, and the third restricting portion 143 is disposed at the position overlapping a portion of the region E1 located between the extension line K1 and the extension line K2. This further reduces the distance between the second positioned portion 140 of the side chute 40 and the first positioned portion 130 of the side guide 30, resulting in further reduction in the positional misalignment of the side chute 40 with respect to the side guide 30. This further improves the accuracy of conveyance of the sheet SH for printing on its back surface.

In this image forming apparatus 1, as illustrated in FIG. 9, the protruding member 142P is provided on the limiting surface 142A of the second restricting portion 142. In the state in which the protrusion 125 is held by and between the limiting surface 142A of the second restricting portion 142 and the limiting surface 143A of the third restricting portion 143 in the widthwise direction W1, the protruding member 142P is located between the limiting surface 142A and the left surface of the protrusion 125 to eliminate the space therebetween. As a result, it is possible to reduce a rattle of the protrusion 125 in the widthwise direction W1.

In this image forming apparatus 1, the protrusion 125 can be smoothly inserted into the space defined by the first restricting portion 141, the second restricting portion 142, and the third restricting portion 143, by being guided by the inclined surface 141B of the first restricting portion 141, the inclined surface 142B of the second restricting portion 142, and the inclined surface 143B of the third restricting portion 143. This facilitates an assembling operation.

In this image forming apparatus 1, as illustrated in FIG. 9, the pin 49 is supported by the supporter 48 extending upward from the first restricting portion 141. With this configuration, the pin 49 is disposed near the positioner 120, resulting in reduction in positional misalignment of the right end portion 49R of the outer circumferential surface of the pin 49 with respect to the third guide wall 33. As a result, the third guide wall 33 of the side guide 30 further accurately limits the position, in the widthwise direction W1, of the sheet SH guided by the conveying surface 100 after the position of the sheet SH in the widthwise direction W1 is limited by the pin 49.

In this image forming apparatus 1, as illustrated in FIG. 8, the fourth restricting portion 44 provided on the first chute wall 41 contacts the first guide wall 31 of the side guide 30 from an upper side thereof, whereby the downstream end portion 41D of the first chute wall 41 and the downstream end portion 42D of the second chute wall 42 are accurately positioned with respect to the side guide 30 in the up and down direction. Also, a lower portion of a step between the first guide wall 31 and the first chute wall 41 provided with the fourth restricting portion 44 is not located upstream of an upper portion of the step in the re-conveying direction D1, thereby preventing the sheet SH from being caught between the downstream end portion 41D of the first chute wall 41 and the first guide wall 31.

In this image forming apparatus 1, as illustrated in FIG. 8, the downstream end portion 41D of the first chute wall 41 is disposed above the first guide wall 31, and the downstream end portion 42D of the second chute wall 42 is disposed below the second guide wall 32. As a result, a lower portion of a step between the downstream end portion 41D of the first chute wall 41 and the first guide wall 31 is not located upstream of an upper portion of the step in the re-conveying direction D1. Also, a lower portion of a step between the downstream end portion 42D of the second chute wall 42 and the second guide wall 32 is not located upstream of an upper portion of the step in the re-conveying direction D1. These configurations prevent the sheet SH from being caught between the side chute 40 and the side guide 30.

While the embodiment has been described above, it is to be understood that the disclosure is not limited to the details of the illustrated embodiment, but may be embodied with various changes and modifications, which may occur to those skilled in the art, without departing from the spirit and scope of the disclosure.

For example, the configuration in which the positioner is disposed at the position overlapping the side guide in the widthwise direction includes: a configuration in which the positioner is disposed at such a position that the entire positioner overlays the side guide; and a configuration in which the positioner is disposed such a position that the positioner overlaps the side guide. This relationship applies to the configuration in which each of the first to third restricting portions is disposed at the position overlaying a portion of the side guide in the widthwise direction.

While the positioner 120 has the protruding portion 127, and the first positioned portion 130 has the recessed portion 137 in the above-described embodiment, the present disclosure is not limited to this configuration. For example, the image forming apparatus 1 may be configured such that the first positioned portion has a protruding portion, and the positioner has a recessed portion.

While the positioner 120 includes the protrusion 125, and the second positioned portion 140 includes the first to third restricting portions 141, 142, 143 in the above-described embodiment, the present disclosure is not limited to this configuration. For example, the image forming apparatus 1 may be configured such that the second positioned portion includes a protrusion, and the positioner includes first to third restricting portions.

The present disclosure may be applied to image forming apparatuses and multi-function peripherals, for example.

What is claimed is:

1. An image forming apparatus comprising:

an image forming unit configured to form an image on a sheet;

a first re-conveyance guide configured to guide a sheet on which an image is formed in a re-conveying direction;

a second re-conveyance guide disposed downstream of the first re-conveyance guide in the re-conveying direction and configured to guide the sheet along a path extending from the first re-conveyance guide to the image forming unit;

a side guide provided at one end portion of the second re-conveyance guide in a widthwise direction orthogonal to the re-conveying direction and configured to contact one end portion of the sheet to regulate of the sheet;

a side chute provided at one end portion of the first re-conveyance guide in the widthwise direction and configured to guide the sheet in the re-conveyance direction toward the side guide; and an engaging portion provided on the second re-conveyance guide, wherein the engaging portion is engaged with a first engaged portion extending downward from an upstream end portion of the side guide in the re-conveying direction and is engaged with a second engaged portion provided on a downstream end portion of the side chute in the re-conveying direction, and wherein the engaging portion comprises a first contact portion configured to contact the first engaged portion from a downstream side in the re-conveying direction, and a second contact portion configured to contact the first engaged portion from an upstream side in the re-conveying direction.

2. The image forming apparatus according to claim 1, wherein at least a portion of the engaging portion overlaps the side guide in the widthwise direction.

3. The image forming apparatus according to claim 1, wherein one of the engaging portion and the first engaged portion comprises a protruding portion protruding toward the other of the engaging portion and the first engaged portion, and wherein the other of the engaging portion and the first engaged portion comprises a recessed portion that holds the protruding portion between portions defining the recessed portion in the widthwise direction.

4. The image forming apparatus according to claim 1, wherein the side chute comprises:

a first chute wall configured to guide the sheet guided by the first re-conveyance guide, by contacting a lower surface of the sheet; and a second chute wall opposed to the first chute wall and configured to guide the sheet guided by the first re-conveyance guide, by contacting an upper surface of the sheet, wherein the engaging portion comprises a protrusion protruding upstream in the re-conveying direction, wherein the second engaged portion comprises:

a first restricting portion formed at the first chute wall and configured to contact the protrusion from an upper side;

a second restricting portion extending downward from the first chute wall and configured to contact the protrusion from one side in the widthwise direction;

a third restricting portion opposed to the second restricting portion, extending downward from the first chute wall, and configured to contact the protrusion from the other side in the widthwise direction; and a connector connecting the second restricting portion and the third restricting portion to each other at a position located below and spaced apart from the first restricting portion, wherein at least a portion of an area occupied by each of the first restricting portion, the second restricting portion, and the third restricting portion in the widthwise direction overlays at least a portion of an area occupied by the side guide in the widthwise direction.

5. The image forming apparatus according to claim 4, wherein one of the second restricting portion and the third restricting portion is provided with a protruding member protruding toward the other of the second restricting portion and the third restricting portion.

6. The image forming apparatus according to claim 4, wherein the first restricting portion is inclined so as to be higher in position at a downstream portion of the first restricting portion in the re-conveying direction than at an upstream portion of the first restricting portion in the re-conveying direction, wherein the second restricting portion is inclined such that a downstream portion of the second restricting portion in the re-conveying direction is located on the one side, in the widthwise direction, of an upstream portion of the second restricting portion in the re-conveying direction, and wherein the third restricting portion is inclined such that a downstream portion of the third restricting portion in the re-conveying direction is located on the other side, in the widthwise direction, of an upstream portion of the third restricting portion in the re-conveying direction.

7. The image forming apparatus according to claim 4, wherein the side chute comprises:

a pin provided at one-side end portions of the first chute wall and the second chute wall in the widthwise direction and configured to restrict a position of the sheet in the widthwise direction by contacting the sheet guided by the first re-conveyance guide; and a supporter extending from the first restricting portion and configured to support the pin.

8. The image forming apparatus according to claim 4, wherein the side chute comprises a fourth restricting portion provided on the first chute wall so as to extend toward a position located downstream of the second restricting portion and the third restricting portion in the re-conveying direction, and the fourth restricting portion contacts the side guide from an upper side.

9. The image forming apparatus according to claim 1, wherein the side chute comprises:

a first chute wall configured to guide the sheet guided by the first re-conveyance guide, by contacting a lower surface of the sheet; and a second chute wall opposed to the first chute wall and configured to guide the sheet guided by the first re-conveyance guide, by contacting an upper surface of the sheet, wherein the side guide comprises:

a first guide wall configured to guide the sheet guided by the second re-conveyance guide, by contacting the lower surface of the sheet; and a second guide wall opposed to the first guide wall and configured to guide the sheet guided by the second re-conveyance guide, by contacting the upper surface of the sheet, wherein a downstream end portion of the first chute wall in the re-conveying direction is disposed above the first guide wall, and wherein a downstream end portion of the second chute wall in the re-conveying direction is disposed below the second guide wall.

10. The image forming apparatus according to claim 1, wherein at least a portion of an area occupied by the second engaged portion in the widthwise direction overlaps at least a portion of an area occupied by the side guide in the widthwise direction.

11. The image forming apparatus according to claim 1, wherein at least a portion of an area occupied by the first engaged portion in the widthwise direction overlaps at least a portion of the area occupied by second engaged portion in the widthwise direction.

12. An image forming apparatus, comprising:

an image forming unit configured to form an image on a sheet;

a first re-conveyance guide configured to guide a sheet on which an image is fored in a re-conveying direction;

a second re-conveyance guide disposed downstream of the first re-conveyance guide in the re-conveying direction and configured to guide the sheet along a path extending from the first re-conveyance guide to the image forming unit;

a side guide provided at one end portion of the second re-conveyance guide in a widthwise direction orthogonal to the re-conveying direction and configured to contact one end portion of the sheet to regulate the sheet;

a side chute provided at one end portion of the first re-conveyance guide in the widthwise direction and configured to guide the sheet in the re-conveyance direction toward the side guide; and a positioner formed integral with the second re-conveyance guide, the positioner being engaged with an upstream end portion of the side guide in the re-conveying direction to position the side guide with respect to the second re-conveyance guide, the positioner being engaged with a downstream end portion of the side chute in the re-conveying direction to position the side chute with respect to the second re-conveyance guide, wherein the positioner comprises a first contact portion configured to contact a first engaged portion from a downstream side in the re-conveying direction, the first engaged portion extending downward from the upstream end portion of the side guide, and a second contact portion configured to contact the first engaged portion from an upstream side in the re-conveying direction.

13. The image forming apparatus according to claim 12, wherein the positioner comprises:

a first engaging portion engaged with the upstream end portion of the side guide; and a second engaging portion engaged with the downstream end portion of the side chute and located upstream of the first engaging portion in the re-conveying direction.

14. The image forming apparatus according to claim 13, wherein the first engaging portion and the second engaging portion are a positioning protrusion protruding upward and formed integrally with the second re-conveyance guide.

15. The image forming apparatus according to claim 12, wherein the positioner is engaged with a second engaged portion of the downstream end portion of the side chute, and wherein at least a portion of an area occupied by the second engaged portion in the widthwise direction overlaps at least a portion of an area occupied by the side guide in the widthwise direction.

16. The image forming apparatus according to claim 12, wherein the positioner is engaged with a second engaged portion of the downstream end portion of the side chute, and wherein at least a portion of an area occupied by the first engaged portion in the widthwise direction overlaps at least a portion of the area occupied by the second engaged portion in the widthwise direction.

17. An image forming apparatus comprising:

an image forming unit configured to form an image on a sheet;

a first re-conveyance guide configured to guide a sheet on which an image is formed in a re-conveying direction;

a second re-conveyance guide disposed downstream of the first re-conveyance guide in the re-conveying direction and configured to guide the sheet along a path extending from the first re-conveyance guide to the image forming unit;

a guide wall provided at one end portion of the second re-conveyance guide in a widthwise direction orthogonal to the re-conveying direction and configured to contact one end portion of the sheet to regulate of the sheet;

a side chute provided at one end portion of the first re-conveyance guide in the widthwise direction and configured to guide the sheet in the re-conveyance direction toward the guide wall; and an engaging portion provided on the second re-conveyance guide, wherein the engaging portion is engaged with a first engaged portion extending downward from an upstream end portion of the guide wall in the re-conveying direction and is engaged with a second engaged portion provided on a downstream end portion of the side chute in the re-conveying direction, and wherein the engaging portion comprises a first surface configured to contact the first engaged portion from a downstream side in the re-conveying direction, and a second surface configured to contact the first engaged portion from an upstream side in the re-conveying direction.

* * * * *